US005547339A

United States Patent [19]

Burgers

[11] Patent Number: 5,547,339

[45] Date of Patent: Aug. 20, 1996

[54] TURBULATOR FOR A FLUID IMPELLING DEVICE

[75] Inventor: Phillip Burgers, San Diego, Calif.

[73] Assignee: Comair Rotron, Inc., San Ysidro, Calif.

[21] Appl. No.: 420,128

[22] Filed: Apr. 11, 1995

[51] Int. Cl.[6] ..... F01D 5/10

[52] U.S. Cl. ..... 415/119; 415/182.1; 415/208.1; 415/914

[58] Field of Search ..... 415/119, 182.1, 415/208.1, 914

[56] References Cited

U.S. PATENT DOCUMENTS

| | | | |
|---|---|---|---|
| 1,787,655 | 1/1931 | Anderson . | |
| 2,566,525 | 9/1951 | Kort | 415/914 |
| 2,975,962 | 3/1961 | Busquet | 415/914 |
| 3,515,498 | 6/1970 | Tomita | 415/208.1 |
| 3,751,909 | 8/1973 | Kohler | 415/914 |
| 3,814,538 | 6/1974 | Sjogvist | 415/182 |
| 4,156,706 | 5/1979 | Bell, Jr. et al. | 261/109 |
| 4,202,296 | 5/1980 | Ninnenmann et al. | 415/914 |
| 4,248,162 | 2/1981 | Skeist | 108/50 |
| 4,315,715 | 2/1982 | Nishiguchi et al. | 415/914 |
| 4,922,277 | 5/1990 | Bertin | 415/914 |
| 5,000,079 | 3/1991 | Mardis | 98/1 |
| 5,400,463 | 3/1995 | Attard et al. | 15/326 |
| 5,402,964 | 4/1995 | Wygnanski | 244/1 |

FOREIGN PATENT DOCUMENTS 1428273 1/1969 Germany .

*Primary Examiner*—John T. Kwon
*Attorney, Agent, or Firm*—Bromberg & Sunstein

[57] ABSTRACT

A turbulator for use with a fluid impelling device comprises a first side, a second side, and an apex toward which the first and second sides taper. The turbulator, circumferentially disposed about an inlet ring located adjacent the impelling device, is coaxially situated with an inlet passage of the inlet ring. The first side, second side, and apex define a triangular cross-section such that as laminar fluid flow from the second side moves over the apex of the turbulator, the laminar fluid flow is transitioned to a turbulent fluid flow on the first side prior to moving into the inlet passage. The turbulator also includes a plurality of evenly spaced slots for disrupting fluid flow symmetry within the inlet passage. The transition to turbulent flow and the disruption of fluid flow symmetry reduce acoustics as fluid is moved through the impelling device.

49 Claims, 11 Drawing Sheets

TURBULATOR FOR A FLUID IMPELLING DEVICE

TECHNICAL FIELD

This invention relates to air inlet devices, and more particularly turbulators for use with a fluid impelling device for transitioning fluid flow from a laminar flow to a turbulent flow.

BACKGROUND ART

In the fan industry, efforts have been made to lower the acoustic level as air is impelled through an axial or centrifugal fan (referred to hereinafter as a "fluid impelling device"). In a fluid impelling device, due to high favorable pressure gradients that drive fluid flow toward an inlet passage, the flow along the surface of the impelling device tends to be laminar. It is well known in the industry that laminar flow has relatively low mean kinetic energy when it is in contact with a solid surface. Specifically, laminar flow behaves in a viscous manner so as to substantially slow fluid flow along the surface of the impelling device as it moves toward the inlet passage.

One type of fluid impelling device includes an abrupt 90 degree turn at a juncture between the surface of the impelling device and the inlet passage. As the fluid flow moves into the inlet passage, a flow separation normally occurs as a portion of the laminar fluid flow cannot redirect its path to conform along the inlet passage. Accordingly, the acoustic level around the inlet passage tends to increase in the presence of a flow separation.

At present, there are several available air inlet devices. One such device is disclosed in U.S. Pat. No. 3,814,538 (Sjoqvist). The device includes two different size cylindrical rings concentrically positioned relative to one another. The smaller inner ring, having a rectangular cross-section, is positioned within the inlet passage of an impelling device. The outer ring, also rectangular in cross-section, is disposed on the surface of the impelling device adjacent the inlet passage. In their respective positions, the inner and outer rings are substantially at right angles to the surface of the impelling device such that a toroidal whirling flow may be generated against the outer ring when fluid flows into the inlet passage. The whirling flow, however, only acts to decrease the friction loss coefficient so as to make the air flow is less viscous across the impelling device.

SUMMARY OF THE INVENTION

The present invention is directed at a turbulator for use with a fluid impelling device. The turbulator, being circular in form, is disposed on an inlet ring such that the turbulator sits circumferentially about an inlet ring, and the turbulator and inlet passage are concentrically aligned along an axis. The turbulator is provided with a first side proximate to the inlet passage, an opposing second side, and an apex toward which the first and second sides taper. The first side, second side and apex define a triangular cross-section.

To decrease the acoustic level as the fluid flow enters the inlet passage, the turbulator is initially adapted to prevent a flow separation. Specifically, the turbulator acts to transition laminar flow on the turbulator's second side to a turbulent flow as the fluid flow moves onto the turbulator's first side so that the fluid flow may conform along the contour into the inlet passage. The turbulator is also provided with a plurality of slots to disrupt flow symmetry along the inlet passage to further decrease the acoustic level. Each slot extends from the first side to the second side of the turbulator and is evenly spaced from an adjacent slot along the turbulator. Preferably, each slot is slanted at an angle relative to a line extending radially across the slot from the axis.

DETAILED DESCRIPTION OF SPECIFIC EMBODIMENTS

Figure 1:
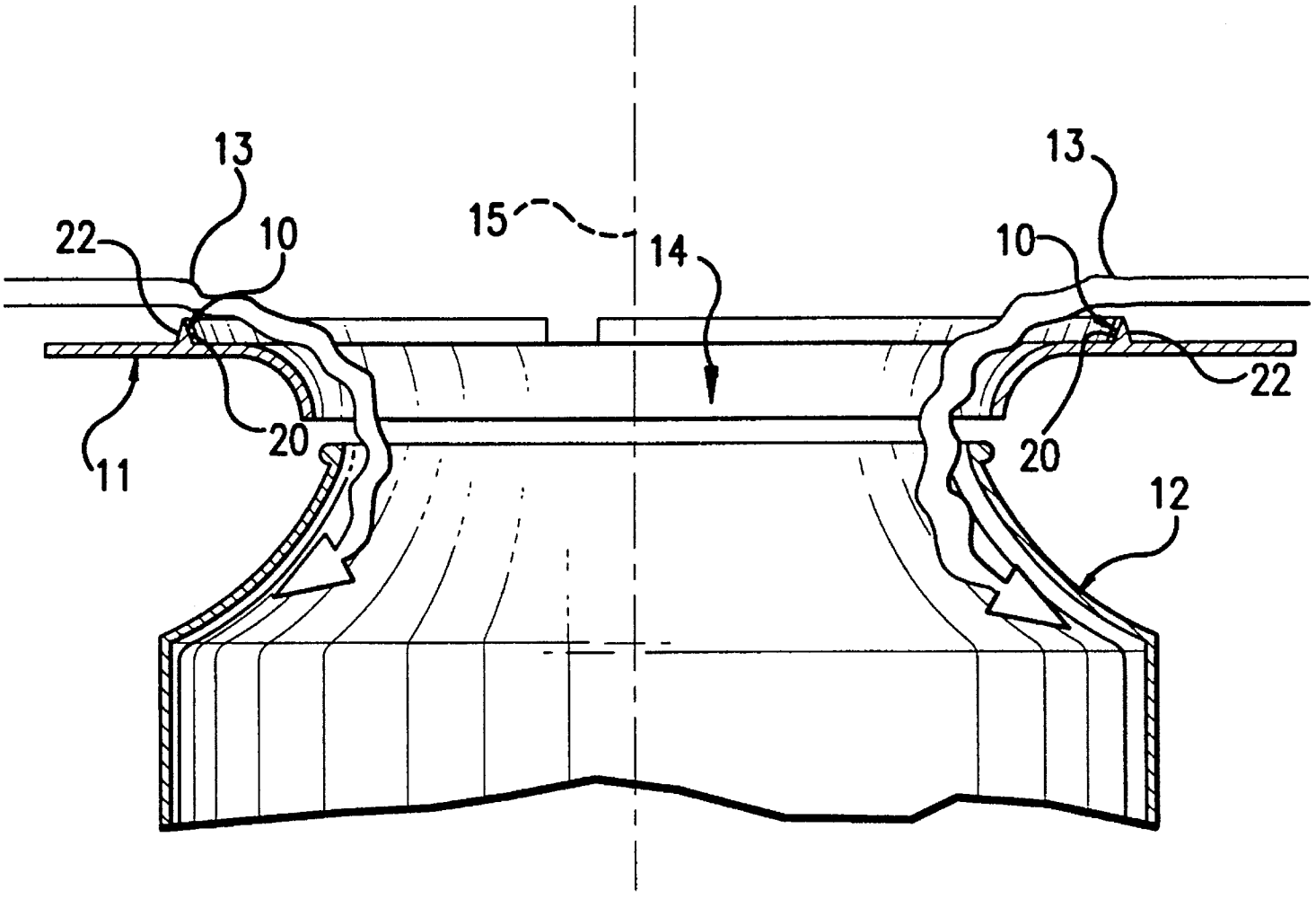
FIG. 1 shows a cross-sectional view of an impelling device with an inlet ring having a turbulator of the present invention.
Figure 2:
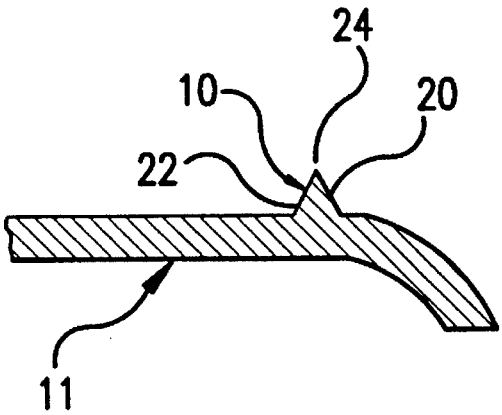
FIG. 2 illustrates, in partial view, a cross-section of the inlet ring and turbulator shown in FIG. 1.

In FIGS. 1 and 2, a turbulator 10 is shown firmly attached to an inlet ring 11 from which an inlet passage 14 extends toward an impelling device 12. The turbulator 10, made of a rigid material, comprises a first side 20, an opposing second side 22 and an apex 24 toward which the first side 20 and the second side 22 taper. In a preferred embodiment, first side 20 and second side 22 meet at an acute angle measuring approximately 42 degrees. As seen in FIG. 1, the presence of the turbulator 10 on inlet ring 11 forcibly transitions fluid flow 13 from a laminar form on the second side 22 to a turbulent form as fluid flow 13 moves onto the first side 20 of turbulator 10. The first side 20, the second side 22, and the apex 24 may define a variety of cross-sectional shapes, for instance, semi-circular or parabolic. Preferably, however, the two sides 20 and 22 taper to a pointed apex such that a cross-sectional shape in the form of a triangle is defined. The first side 20, being substantially smooth, sits proximate to the inlet passage 14 such that the first side 20 is at a constant predetermined distance from the inlet passage 14. Similarly, the opposing second side 22 of turbulator 10 is at a constant distance away from inlet passage 14. As the dimensions of any two differently manufactured fluid impelling devices may vary, the constant distance from the first side 20 to the inlet passage 14 must also vary. Nevertheless, the constant distance from the first side 20 to the inlet passage 14 must be maintained within a critical range so as to prevent fluid flow 13 on the first side 20 of turbulator 10 from returning to a laminar flow prior to entering inlet passage 14.

Figure 3:
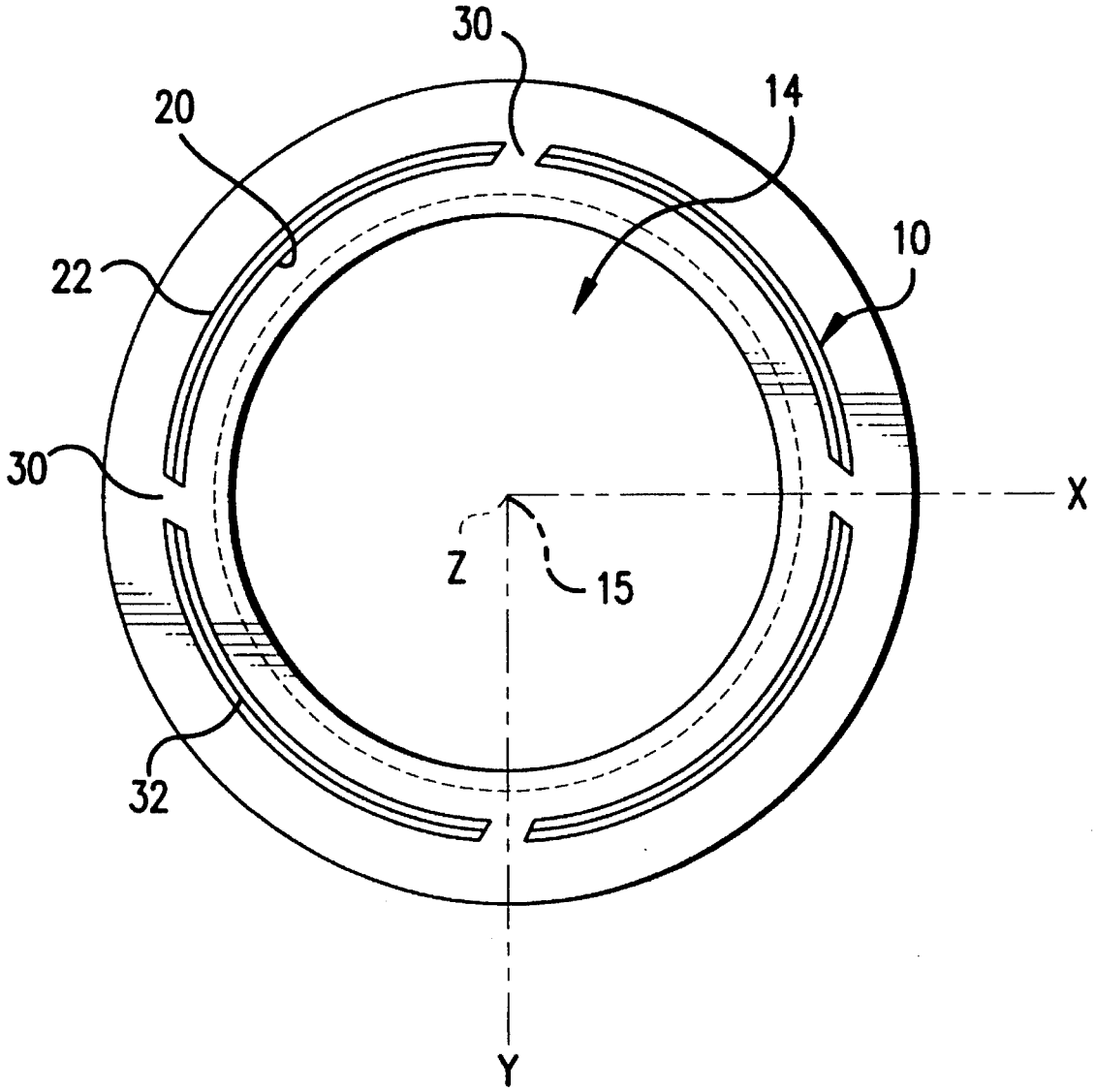
FIG. 3 is a top view of a turbulator according to one embodiment of the present invention circumferentially situated about an inlet ring.

When viewed directly from above, looking now at FIG. 3, turbulator 10 is a single ring that is circumferentially situated about inlet passage 14 such that the turbulator 10 and the inlet passage 14 are concentrically aligned along an axis 15. The circular dimension of turbulator 10, defined by the first side 20 and the second side 22, remains substantially constant around inlet passage 14. Turbulator 10 preferably includes a plurality of slots 30 extending from the first side 20 to the second side 22. In a specific embodiment, four slots 30 are evenly spaced along the turbulator 10 such that each slot is situated directly opposite a nonadjacent slot. In this manner, turbulator 10 comprises four arcuate segments 32 of equal length. If preferred, the number of slots 30 may be varied. When this occurs, the number of arcuate segments 32, being defined by the number of slots 30, also varies. In the event the number of slots 30 is odd, each of slots 30 is not situated directly opposite a nonadjacent slot. Turbulator 10 may also be constructed without slots 30.

Figure 4:
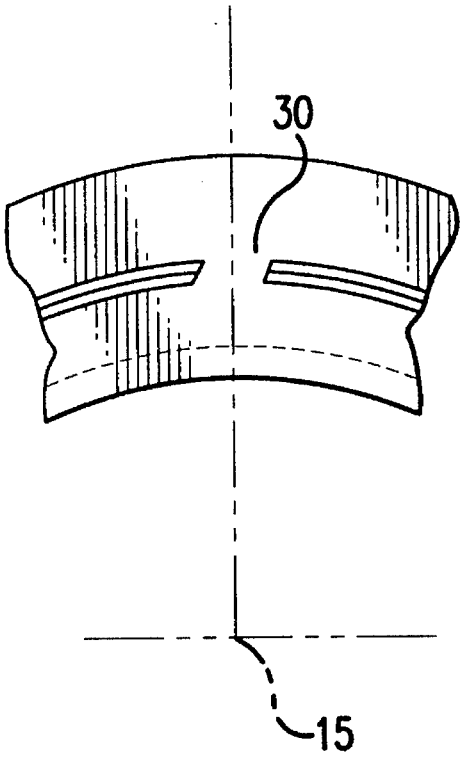
FIG. 4 shows a portion of the turbulator shown in FIG. 3 with a slot extending thereacross.

Referring now to FIG. 4, each of the slots 30 is constructed so that it is slanted. In particular, each of the slots 30 is at an angle relative to a line extending radially across the slot from axis 15. The angle at which each slot 30 is situated is preferably approximately 30 degrees. As is discussed hereinafter in detail, the turbulator 10 and slots 30 are provided to reduce the acoustic level caused the fluid flow moving across the inlet ring 11.

In one embodiment of the invention wherein inlet passage 14 has a diameter of about 3.42 inches and slots 30 are each approximately 0.22 inch, turbulator 10 has a height of approximately 0.13 inch, a width of about 0.10 inch, and a diameter of about 4.20 inches. To this end, the first side 20 of turbulator 10 is at a constant distance of approximately 0.78 inch from the inlet passage 14. Of course, for an impelling device having an inlet ring with a different size inlet passage, the diameter of turbulator 10 may increase or decrease accordingly. However, as noted above, the manner in which turbulator 10 varies must not be so significant as to allow fluid flow 13 to become laminar on the first side 20 prior to entering inlet passage 14. Moreover, the height of turbulator 10 must kept relatively less than the distance from the first side 20 of turbulator 10 to the inlet passage 14.

In the construction of turbulator 10, a material similar to that used in making the inlet ring 11 may be employed. In one embodiment of the present invention, turbulator 10 is made of plastic. Turbulator 10 may also be made from a material completely different from that used in the inlet ring 11. Thus while inlet ring 11 may be, for instance, metallic, turbulator 10 may be made of plastic. When attaching turbulator 10 to the inlet ring 11, turbulator 10 may be attached by any method well known in the industry, for example, adhesive bonding. Preferably, the turbulator 10 is integrally molded to the inlet ring 11.

Figure 5:
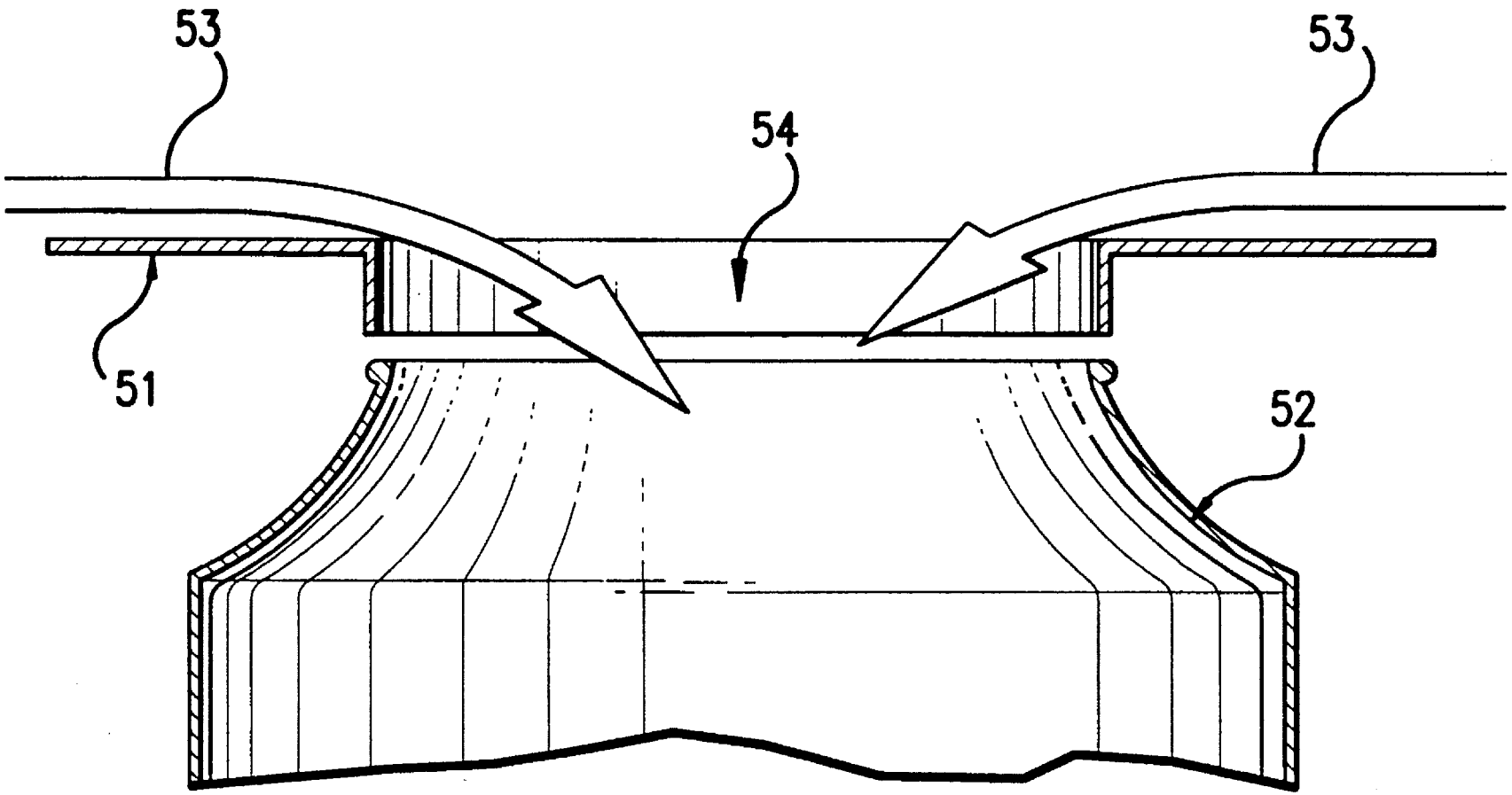
FIG. 5 illustrates a fluid impelling device with an inlet ring having a right angle inlet passage.

FIG. 5 illustrates an impelling device 52 with an inlet ring 51 having a right angle inlet passage 54. Inlet ring 51 is without a turbulator. Thus when fluid flow 53 reaches inlet passage 54, it must make an abrupt 90 degree change in direction. This abrupt change in direction often leads to a flow separation at the entrance to inlet passage 54. In other words, fluid flow 53, in its viscous laminar form, cannot conform to the contour along the surface of the inlet passage 54. Instead fluid flow 53 continues to move toward the center of the inlet passage 54. As this flow separation occurs, an increase in the acoustic level results in the impelling device 52.

Figure 6:
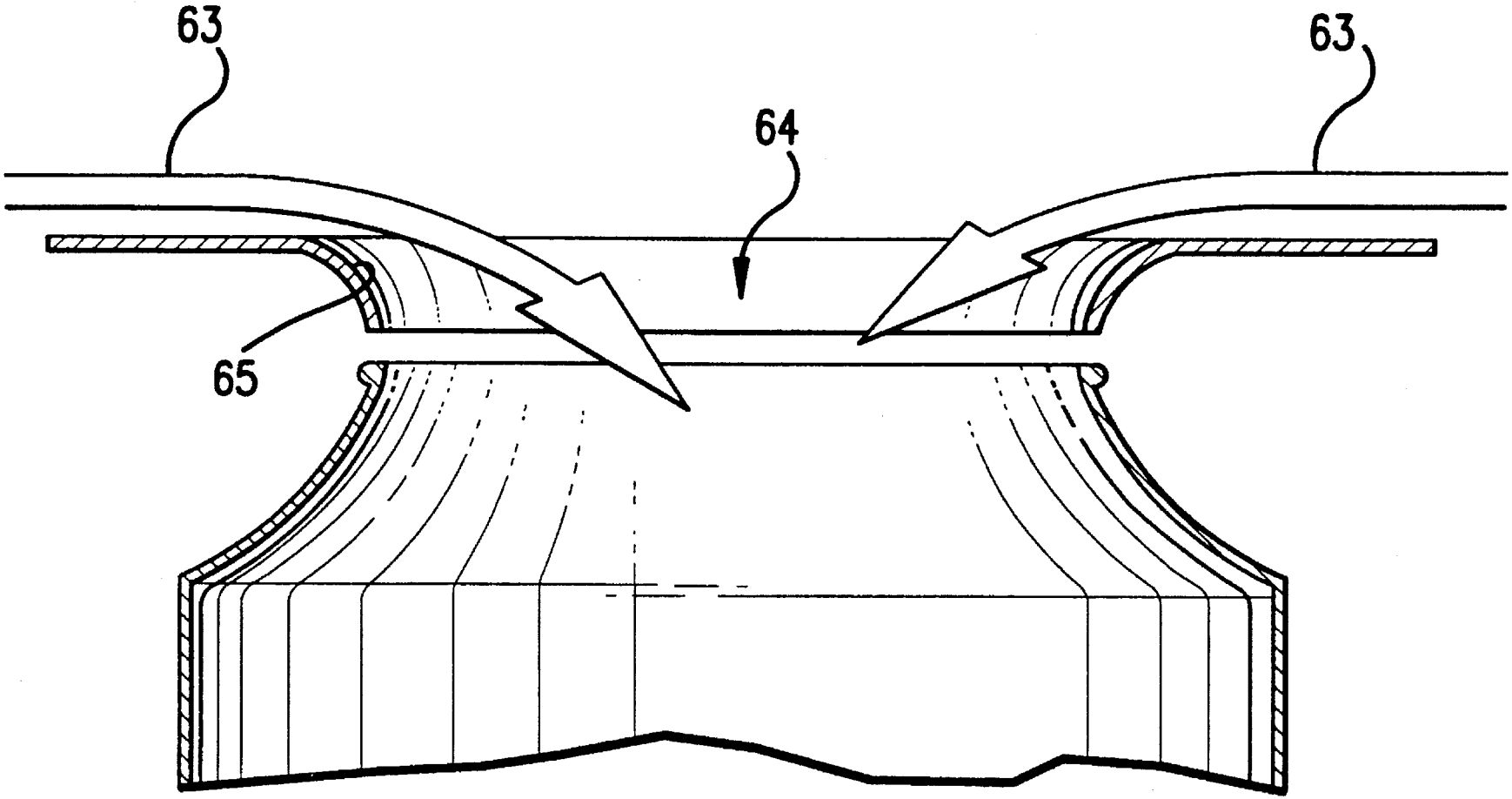
FIG. 6 illustrates a fluid impelling device with an inlet ring having a contoured inlet passage.

In FIG. 6, even when inlet passage 64 has a curved surface 65 to allow fluid flow 63 to contour into the inlet passage 64, if a turbulator is not present, fluid flow 63 remains laminar and viscous. In its laminar form, fluid flow 63 cannot conform along the curved surface 65 of inlet passage 64. Accordingly, flow separation similar to that seen in FIG. 5 may result leading to an increase in the acoustic level.

By attaching a turbulator 10 to the impelling device 12, as shown in FIG. 1, the acoustic level may be decreased. In particular, the presence of turbulator 10 in the path of fluid flow 13 forces laminar flow on the second side 22 of turbulator 10 to transition to turbulent flow as it moves onto the first side 20. In its turbulent form, fluid flow 13 has a substantially high mean kinetic energy relative to the laminar form. When high kinetic energy is imparted to fluid flow 13 near inlet passage 14, fluid flow 13 becomes less viscous and free-flowing. With less viscosity, fluid flow 13 may easily negotiate changes in the flow trajectory so that it may conform along the contour of inlet passage 14. The ability to conform along the contour of inlet passage 14 is preferred as it can prevent a flow separation to decrease the acoustic level.

A separation of laminar flow from the inlet passage 14 may not be the only cause of an undesirable acoustic level. When fluid flow 13 ms caused to enter inlet passage 14, it moves along inlet passage 14 in a circular motion to provide a flow symmetry along axis 15. This flow symmetry, like flow separation, normally increases the acoustic level as fluid flow 13 moves along the inlet passage 14. By providing turbulator 10 with slots 30 slanted substantially at 30 degrees to a line extending radially from axis 15, the flow symmetry of fluid flow 13 within inlet passage 14 is interrupted. The interruption results at least in part from fluid flow 13 moving across slots 30 from the second side 22 of turbulator 10 and being subsequently projected into inlet passage 14 in a direction opposite the circular fluid motion within inlet passage 14. When flow symmetry is interrupted, the acoustic level is further decreased. In the preferred embodiment of the invention, slots 30 are slanted in a direction opposite the circular motion of fluid flow 13 within inlet passage 14. Specifically, from the perspective of FIG. 4, when fluid flow 13 is moving in a clockwise direction, slot 30, following from the first side 20 to the second side 22 of turbulator 10, slants from left to right. Alternatively, slots 30 may be constructed to slant in the direction of the circular flow.

As is explained hereinafter, evidence of decreasing acoustic levels can be clearly demonstrated in a test measuring the acoustic performance of an inlet ring without a turbulator against an inlet ring with a turbulator of the present invention. The test measured the acoustic levels at increasing flow rates along a frequency spectrum having a range from about 100 Hz to about 10 KHz. The test used an inlet ring having a curved inlet passage with a diameter of 3.42 inches, and a backward curved centrifugal impelling device capable of providing a flow rate from approximately 0 to approximately 200 cfm. As shown in FIGS. 7A–7D, A represents an inlet ring without a turbulator while B represents an inlet ring with a segmented turbulator having a triangular cross-section and a diameter of about 4.20 inches.

Figure 7A:
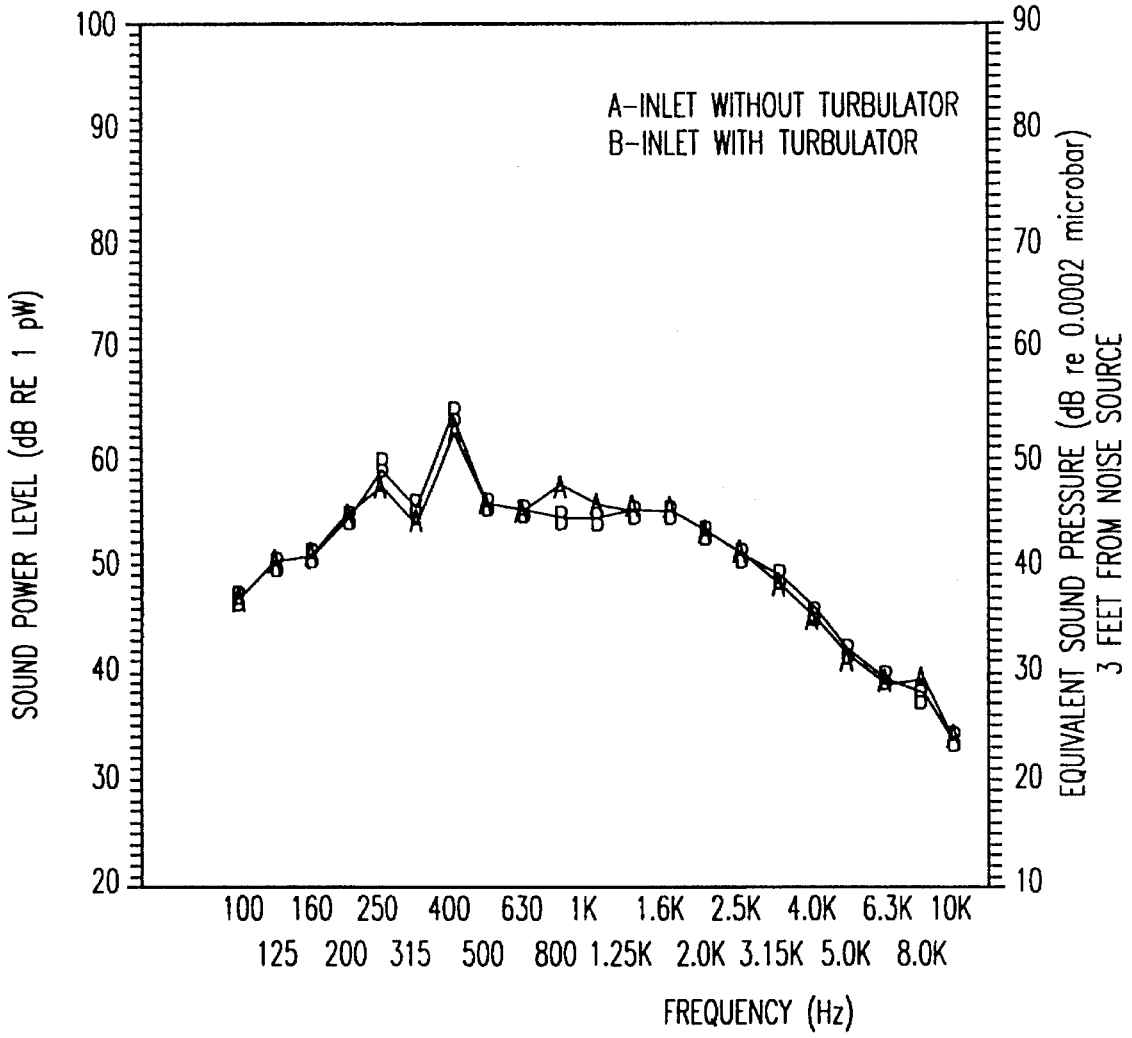
FIGS. 7A–7D are line graphs showing the results of an acoustic test of an inlet ring without a turbulator and an inlet ring with a turbulator of the present invention.
Figure 7B:
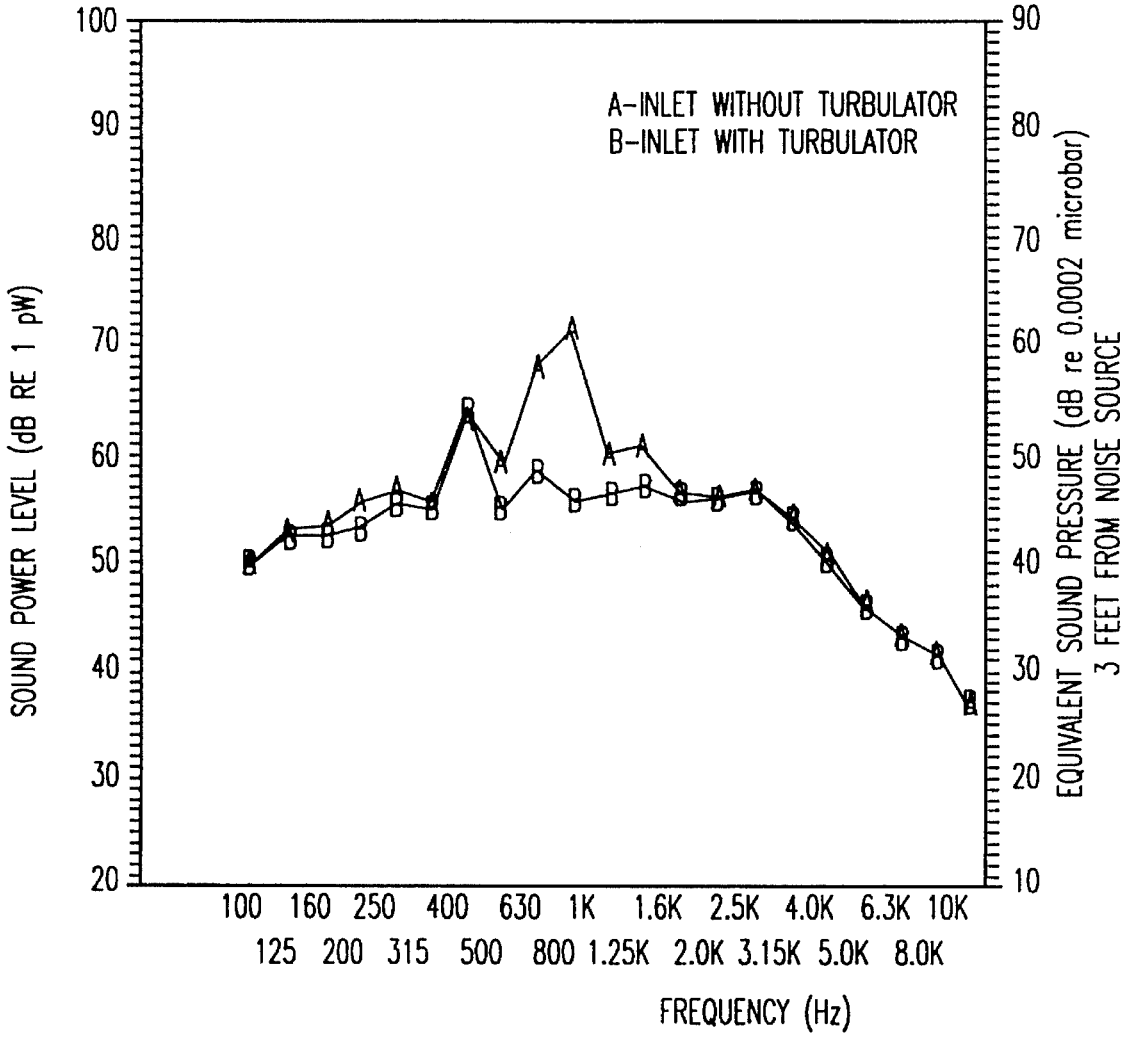
Figure 7C:
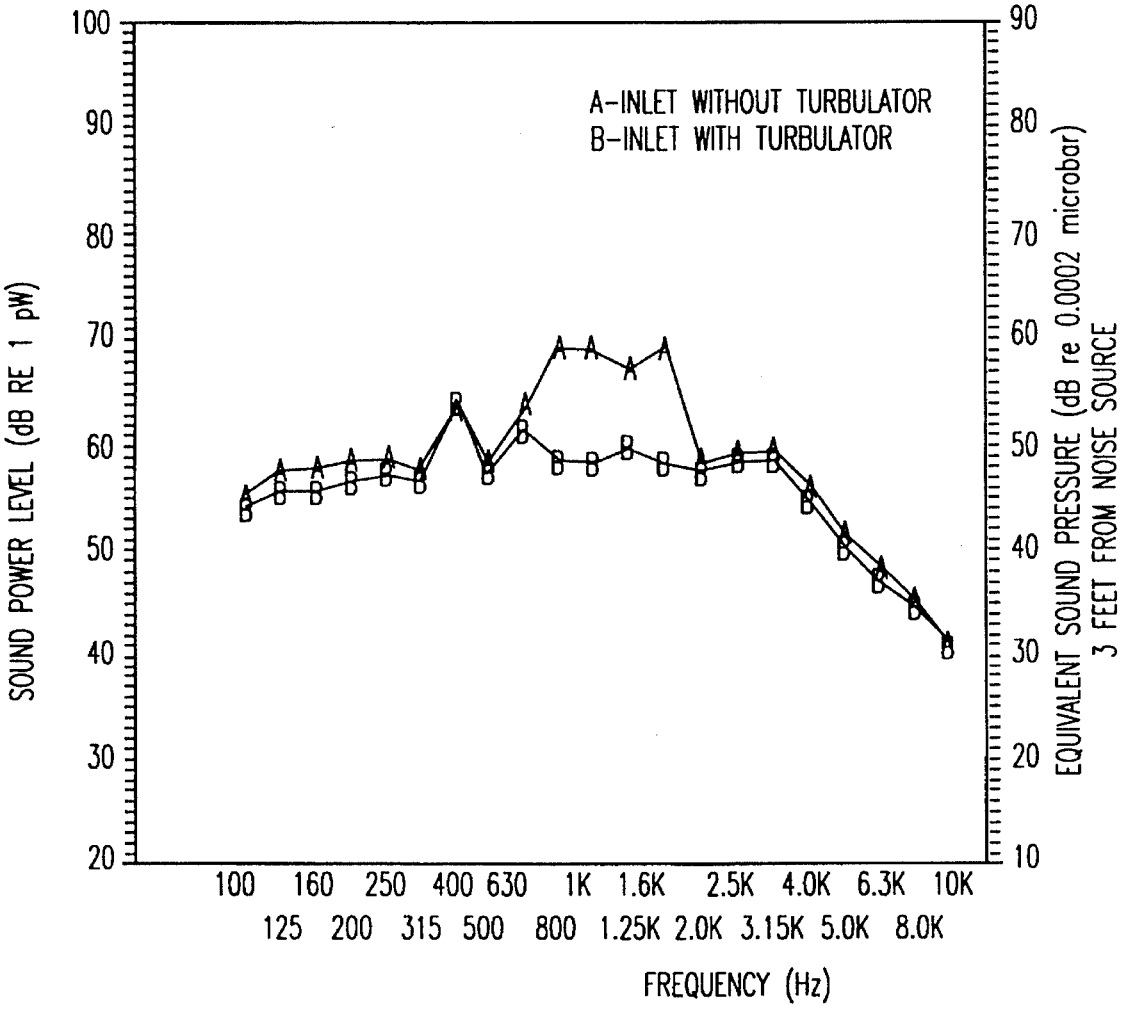
Figure 7D:
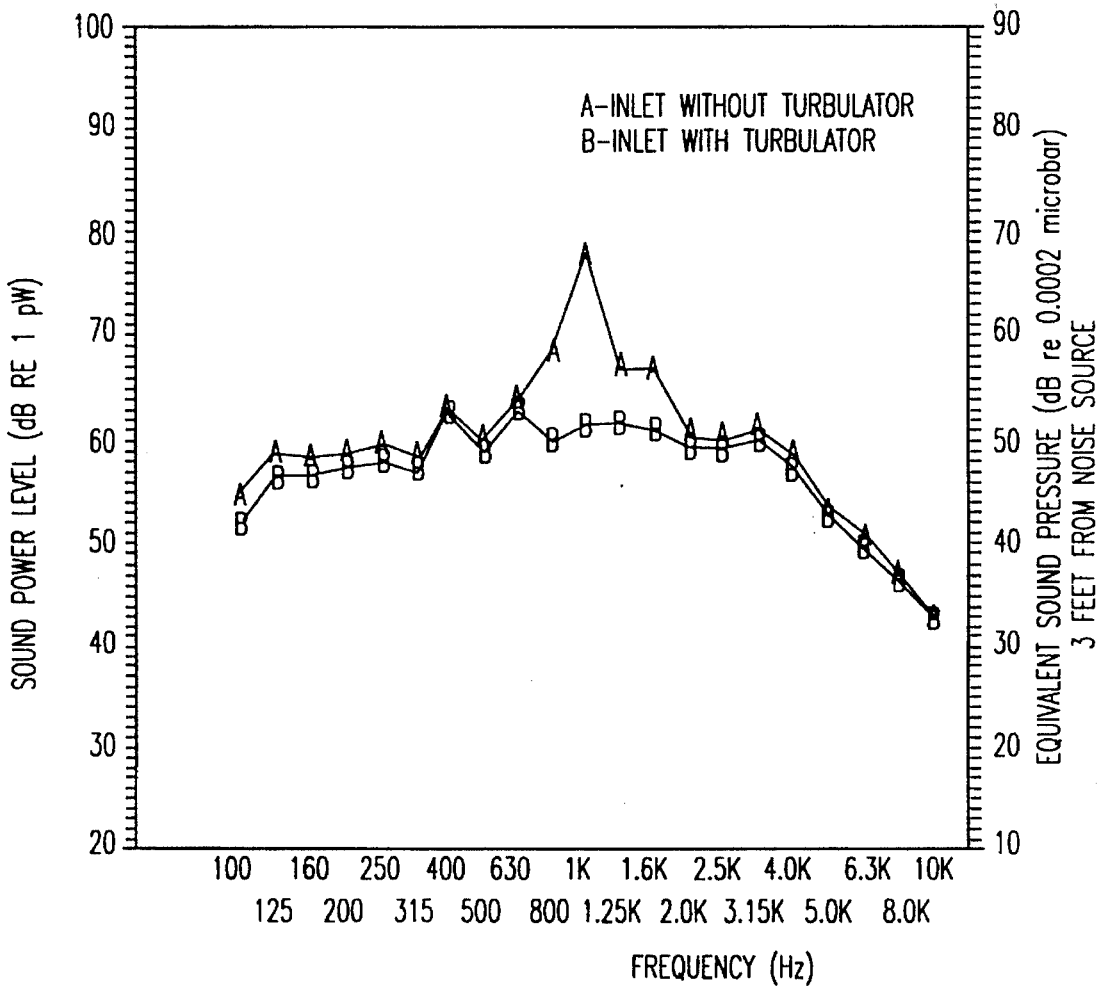

In FIG. 7A, where the flow rate ranges from 83.6 to 84.3 cfm, the acoustic level for B is noticeably lower from approximately 630 Hz to approximately 1.25 KHz. The addition of a segmented turbulator with a triangular cross-section on the inlet has indeed lowered the acoustic level, even at a relatively low flow rate. In FIG. 7B, where the flow rate has been increased to approximately 118.1 cfm, the acoustic level for B is dramatically lower from about 400 Hz to about 1.60 KHz. As the flow rate increases to a range from about 143.4 cfm to 145 cfm, the acoustic level for B, as illustrated in FIG. 7C remains significantly lower from about 500 Hz to about 2.0 KHz. Even when the flow rate at which B is tested is significantly higher than the flow rate at which A is tested, 166.2 cfm to 159.0 cfm respectively, the acoustic level for B, as shown in FIG. 7D, remains noticeably lower.

As the results indicate, the significant acoustic difference between A and B is due to the use of a segmented turbulator with a triangular cross-section in B. In addition, the combination of a triangular cross-section and plurality of slots has contributed to a decrease of the acoustic level spatially in three dimensions. Specifically, the prevention of flow separation near the inlet passage 14 along the X and Y axes (FIG. 3) lowers the acoustic level in the X and Y directions. Moreover, the disruption of flow symmetry along the Z axis (perpendicular to the plane of the paper) within the inlet passage 14 lowers the acoustic level in the Z direction.

Figure 8:
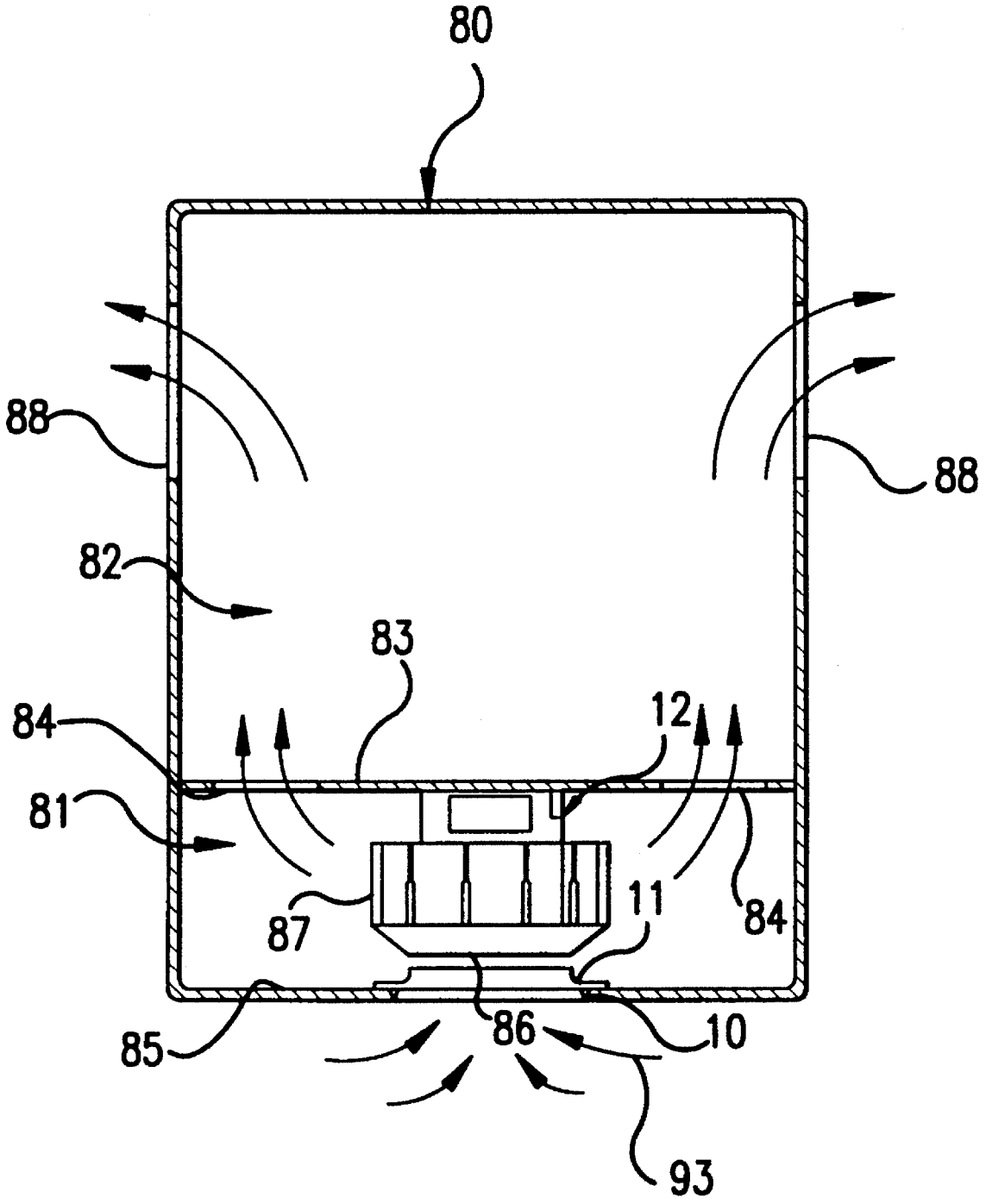
FIG. 8 shows a perspective view of the interior of a cabinet with a fluid impelling device and an inlet ring having a turbulator of the present invention.

Referring now to FIG. 8, an impelling device 12 and an inlet ring 11 having turbulator 10 are shown cooling the interior of a cabinet 80. Specifically, cabinet 80 has a first chamber 81 and a second chamber 82. A wall 83 having openings 84 separates the first chamber 81 from the second chamber 82. Inlet ring 11 with turbulator 10 is mounted within the interior of the first chamber 81 against an intake surface 85. Impelling device 12, having an input surface 86 and an output surface 87, is also within the first chamber 81. Impelling device is attached to wall 83 such that input surface 86 is coaxial with inlet ring 11 and is separated from inlet ring 11 by a space. However, if it is desired, inlet ring 11 and input surface 86 may be integrally made.

Figure 9:
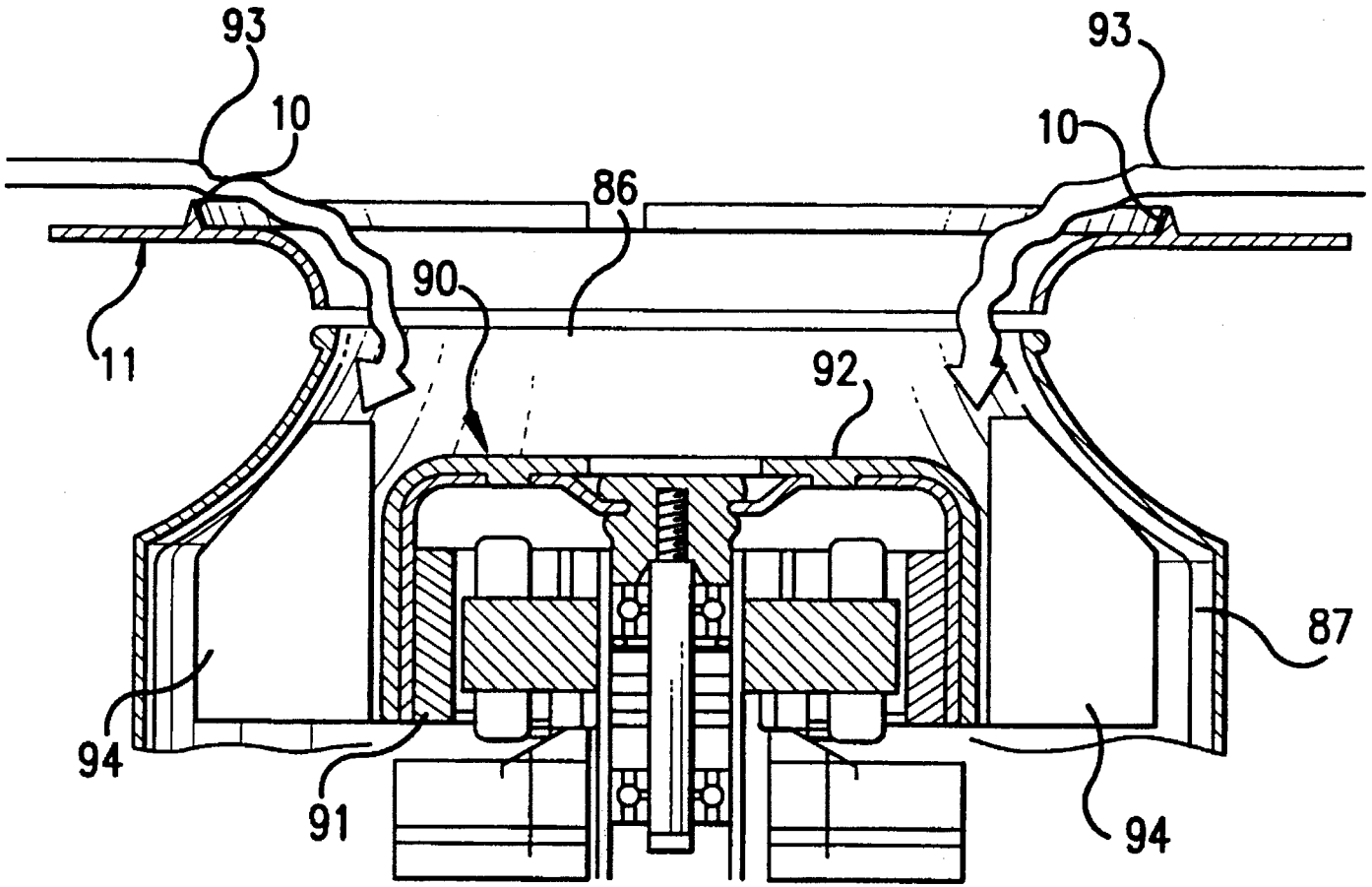
FIG. 9 shows a cross-sectional view of a fluid impelling device of the present invention.

When impelling device 12 is actuated, looking now at FIG. 9 a fan 90 is rotated by a motor 91 situated within a hub 92 to create a high favorable pressure gradient that drives fluid flow 93 toward the inlet ring 11. Hub 92 coaxially situated relative to the inlet ring 11 includes a plurality of blades 94 evenly disposed around hub 91. Prior to entering the inlet ring 11, the fluid flow 93 is converted into a turbulent flow by turbulator 10. Fluid flow 93 is then pulled through the input surface 86 and pushed across the output surface 87 into the first chamber 81 where fluid flow 93 is thereafter forced into the second chamber 82 (FIG. 8) to pressurize the second chamber 82. Any subsequent flow into the second chamber 82 would force fluid flow 93 out through openings 88. Because the impelling device 12 may continuously direct fluid flow 93 into and out of cabinet 80, there may exist a constant noise level as fluid flow 93 is moved across the inlet ring 11. The inclusion of turbulator 10 may therefore reduce the noise which may otherwise be annoying.

Turbulator 10 may also increase fluid flow aerodynamics. Test results have also shown that at zero static pressure (pressure exerted perpendicularly to a duct wall by fluid confined therein), the use of turbulator 10 increases fluid flow aerodynamics through impelling device 12. In other words, when there is no static pressure and fluid is moving at free-delivery condition, turbulator 10 increases the amount of fluid flow 13 moving through impelling device 12.

While the invention has been described in connection with specific embodiments thereof, it will be understood that it is capable of further modification. This application is intended to cover any variations, uses, or adaptations of the invention following, in general, in principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A turbulator for use in a fluid impelling device having an inlet passage through which fluid enters, the turbulator comprising:

a first side proximate to the inlet passage;

an opposing second side; and an apex toward which the first and second sides taper into an angle substantially less than ninety degrees;

the turbulator being circumferentially situated about the inlet passage is adapted to transition fluid flowing toward the inlet passage from the turbulator's second side to the turbulator's first side from a laminar flow to a turbulent flow prior to the fluid entering the inlet passage, the turbulator further being concentrically aligned with the inlet passage along an axis.

2. A turbulator as set forth in claim 1 wherein on the second side of the turbulator the laminar flow has a relatively low mean kinetic energy so as to be viscous.

3. A turbulator as set forth in claim 1 wherein on the first side of the turbulator the turbulent flow has a relatively high mean kinetic energy, and tends to be free-flowing so as to prevent a flow separation by allowing the fluid flow to contour along the inlet passage.

4. A turbulator as set forth in claim 3 wherein the prevention of flow separation decreases an acoustic level.

5. A turbulator as set forth in claim 1 wherein the first side is at a predetermined distance from the inlet passage so as to prevent the turbulent flow from returning to laminar flow.

6. A turbulator as set forth in claim 5 further including a height, the height being less than the distance at which the first side is situated from the inlet passage.

7. A turbulator as set forth in claim 1 wherein the apex is a point toward which the first and second sides taper.

8. A turbulator as set forth in claim 1 wherein the first side, the second side, and the apex of the turbulator define a triangular cross-section.

9. A turbulator as set forth in claim 1 further including a plurality of slots extending from the first side to the second side of the turbulator.

10. A turbulator for use in a fluid impelling device having an inlet passage through which fluid enters, the turbulator comprising:

a first side proximate to the inlet passage;

an opposing second side;

an apex toward which the first and second sides taper; and a plurality of slots extending from the first side to the second side of the turbulator, each of the slots being evenly spaced from an adjacent slot along the turbulator;

the first side, the second side, and the apex of the turbulator defining a triangular cross-section;

the turbulator being circumferentially situated about the inlet passage is adapted to transition fluid flowing toward the inlet passage from the turbulator's second side to the turbulator's first side from a laminar flow to a turbulent flow prior to the fluid entering the inlet passage, the turbulator further being concentrically aligned with the inlet passage along an axis.

11. A turbulator as set forth in claim 10 wherein each of the slots is at an angle relative to a line extending radially across each slot from the axis.

12. A turbulator as set forth in claim 10 wherein the slots reduce acoustic level by disrupting fluid flow symmetry within the inlet passage.

13. A turbulator for use in a fluid impelling device having an inlet passage through which fluid enters the turbulator comprising:

a first side proximate to the inlet passage;

an opposing second side;

an apex toward which the first and second sides taper; and a plurality of slots extending from the first side to the second side of the turbulator, each of the slots being evenly spaced from an adjacent slot along the turbulator;

the turbulator being circumferentially situated about the inlet passage is adapted to transition fluid flowing toward the inlet passage from the turbulator's second side to the turbulator's first side from a laminar flow to a turbulent flow prior to the fluid entering the inlet passage, the turbulator further being concentrically aligned with the inlet passage along an axis.

14. A turbulator as set forth in claim 13 wherein each of the slots is at an angle relative to a line extending radially across each slot from the axis.

15. A turbulator for use in a fluid impelling device having an inlet passage through which fluid enters, the turbulator comprising:

a first side proximate to the inlet passage;

an opposing second side; and a plurality of slots extending from the first side to the second side of the turbulator, wherein each slot is evenly spaced from an adjacent slot along the turbulator;

the turbulator being circumferentially situated about the inlet passage is adapted to transition fluid flowing toward the inlet passage from the turbulator's second side to the turbulator's first side from a laminar flow to a turbulent flow prior to the fluid entering the inlet passage, the turbulator further being concentrically aligned with the inlet passage along an axis.

16. A turbulator as set forth in claim 15 wherein each slot is further at an angle relative to a line extending radially across each slot from the axis.

17. An inlet system for use with a fluid impelling device comprising:

an inlet ring having an inlet passage; and a turbulator situated upstream and outside of the inlet passage for transitioning fluid flowing toward the inlet passage from a laminar flow to a turbulent flow prior to the fluid entering the inlet passage, the turbulator, being circumferentially positioned so that it is concentrically aligned with the inlet passage along an axis, includes a first side proximate to the inlet passage, an opposing second side, and an apex toward which the first and second sides taper.

18. An inlet system as set forth in claim 17 wherein the inlet passage is curved.

19. An inlet system as set forth in claim 17 wherein on the first side of the turbulator the turbulent flow has a relatively high mean kinetic energy, and tends to be free-flowing so as to prevent a flow separation by allowing the fluid flow to contour along the inlet passage.

20. A inlet system as set forth in claim 19 wherein the prevention of flow separation decreases an acoustic level.

21. An inlet system as set forth in claim 17 wherein the first side is at a predetermined distance from the inlet passage so as to prevent the turbulent flow from returning to laminar flow.

22. An inlet system as set forth in claim 21 wherein the turbulator further includes a height, the height being less than the distance at which the first side is situated from the inlet passage.

23. An inlet system as set forth in claim 17 wherein the apex is a point toward which the first and second sides taper.

24. An inlet system as set forth in claim 17 wherein the first side, the second side, and the apex of the turbulator define a triangular cross-section.

25. A turbulator as set forth in claim 17 further including a plurality of slots extending from the first side to the second side of the turbulator.

26. An inlet system for use with a fluid impelling device comprising:

an inlet ring having an inlet passage; and a turbulator circumferentially situated about the inlet passage for transitioning fluid flowing toward the inlet passage from a laminar flow to a turbulent flow prior to the fluid entering the inlet passage, the turbulator being concentrically aligned with the inlet passage along an axis includes a first side proximate to the inlet passage, an opposing second side, an apex toward which the first and second sides taper, and a plurality of slots extending from the first side to the second side of the turbulator, each of the slots being evenly spaced from an adjacent slot along the turbulator, the first side, the second side, and the apex of the turbulator defining a triangular cross-section.

27. An inlet system as set forth in claim 26 wherein each of the slots is at an angle relative to a line extending radially across each slot from the axis.

28. An inlet system as set forth in claim 26 wherein the slots reduce an acoustic level by disrupting fluid flow symmetry within the inlet passage.

29. A fluid impelling device comprising:

a frame having input and output surfaces;

an inlet ring disposed adjacent the input surface, the inlet ring having a inlet passage;

a hub within the frame spaced away from the inlet ring, the hub being coaxially situated relative to the inlet ring;

a plurality of blades attached to and evenly spaced around the hub for moving fluid;

a motor within the hub for rotating the hub; and a turbulator situated upstream and outside of the inlet passage for transitioning fluid flowing toward the inlet passage from a laminar flow to a turbulent flow prior to the fluid entering the inlet passage, the turbulator, being circumferentially positioned so that it is concentrically aligned with the inlet passage along an axis, includes a first side proximate to the inlet passage, an opposing second side, and an apex toward which the first and second sides taper.

30. A device as set forth in claim 29 wherein the inlet passage is curved.

31. A device as set forth in claim 29 wherein on the first side of the turbulator the turbulent flow has a relatively high mean kinetic energy, and tends to be free-flowing so as to prevent a flow separation by allowing the fluid flow to contour along the inlet passage.

32. A device as set forth in claim 31 wherein the prevention of flow separation decreases an acoustic level.

33. A device as set forth in claim 29 wherein the first side is at a predetermined distance from the inlet passage so as to prevent the turbulent flow from returning to laminar flow.

34. A device as set forth in claim 33 wherein the turbulator further includes a height, the height being less than the distance at which the first side is situated from the inlet passage.

35. A device as set forth in claim 29 wherein the apex is a point toward which the first and second sides taper.

36. A device as set forth in claim 29 wherein the first side, the second side, and the apex of the turbulator define a triangular cross-section.

37. A turbulator as set forth in claim 29 further including a plurality of slots extending from the first side to the second side of the turbulator.

38. A fluid impelling device comprising:

a frame having input and output surfaces;

an inlet ring disposed adjacent the input surface, the inlet ring having a inlet passage;

a hub within the frame spaced away from the inlet ring, the hub being coaxially situated relative to the inlet ring;

a plurality of blades attached to and evenly spaced around the hub for moving fluid;

a motor within the hub for rotating the hub; and a turbulator circumferentially situated about the inlet passage for transitioning fluid flowing toward the inlet passage from a laminar flow to a turbulent flow prior to the fluid entering the inlet passage, the turbulator being concentrically aligned with the inlet passage along an axis includes a first side proximate to the inlet passage, an opposing second side, an apex toward which the first and second sides taper, and a plurality of slots extending from the first side to the second side of the turbulator, each of the slots being evenly spaced from an adjacent slot along the turbulator, the first side, the second side, and the apex of the turbulator defining a triangular cross-section.

39. A device as set forth in claim 38 wherein each of the slots is at an angle relative to a line extending radially across each slot from the axis.

40. A device as set forth in claim 38 wherein the slots reduce an acoustic level by disrupting fluid flow symmetry within the inlet passage.

41. A method for transitioning fluid flow from a laminar flow to a turbulent flow comprising:

(a) providing an impelling device;

(b) equipping the impelling device with an inlet ring;

(c) securing a circular turbulator to the inlet ring, the turbulator having a first side, an opposing second side, and an apex toward which the first and second sides taper into an angle substantially less than ninety degrees;

(d) actuating the impelling device so as to create an environment wherein on the second side of the turbulator the fluid flow tends to be laminar with relatively low mean kinetic energy; and (e) allowing the laminar flow to move to the first side of the turbulator such that at the apex of the turbulator the laminar flow is transitioned to a turbulent flow having relatively high mean kinetic energy.

42. An inlet system for use with a fluid impelling device comprising:

an inlet ring having an inlet passage; and a turbulator circumferentially situated about the inlet passage, the turbulator being concentrically aligned with the inlet passage along an axis includes a first side proximate to the inlet passage, an opposing second side, an apex toward which the first and second sides taper, and a plurality of slots extending from the first side to the second side of the turbulator.

43. A turbulator as set forth in claim 42 wherein each of the slots is at an angle relative to a line extending radially across each slot from the axis.

44. An inlet system for use with a fluid impelling device comprising:

an inlet ring having a first surface, and an adjacent second surface relatively perpendicular to the first surface and defining an inlet passage; and a turbulator being situated circumferentially on the first surface is adapted to transition laminar fluid flow to a turbulent flow.

45. An inlet system as set forth in claim 44 wherein the turbulator includes a first side proximate the inlet passage, an opposing second side, an apex toward which the first and second side taper.

46. An inlet system for use with a fluid impelling device comprising:

an inlet ting having a first surface, and an adjacent second surface relatively perpendicular to the first surface and defining an inlet passage: and a turbulator being situated circumferentially on the first surface is adapted to transition laminar fluid flow to a turbulent flow, the turbulator including a first side proximate the inlet passage, an opposing second side, and an apex toward which the first and second side taper;

wherein the turbulator includes a plurality of slots.

47. (New) An inlet system as set forth in claim 44 wherein the fluid flow along the first surface is laminar flow, and fluid flow along the second surface is turbulent flow.

48. A fluid impelling device comprising:

a frame having input and output surfaces;

an inlet ring disposed adjacent the input surface, the inlet ring having a inlet passage;

a hub within the frame spaced away from the inlet ring, the hub being coaxially situated relative to the inlet ring;

a plurality of blades attached to and evenly spaced around the hub for moving fluid;

a motor within the hub for rotating the hub; and a turbulator circumferentially situated about the inlet passage, the turbulator being concentrically aligned with the inlet passage along an axis includes a first side proximate to the inlet passage, an opposing second side, an apex toward which the first and second sides taper, and a plurality of slots extending from the first side to the second side of the turbulator.

49. A turbulator device as set forth in claim 48 wherein each of the slots is at an angle relative to a line extending radially across each slot from the axis.

* * * * *

UNITED STATES PATENT AND TRADEMARK OFFICE

CERTIFICATE OF CORRECTION

PATENT NO. : 5,547,339

DATED : August 20, 1996

INVENTOR(S) : Phillip Burgers

It is certified that error appears in the above-identified patent and that said Letters Patent is hereby corrected as shown below:

Col. 10, line 24, replace --ring--for "ting"

Signed and Sealed this

Ninth Day of January, 2001

*Attest:*

Q. TODD DICKINSON

*Attesting Officer*

*Commissioner of Patents and Trademarks*